United States Patent [19]

Fröhler et al.

[11] 3,972,796

[45] Aug. 3, 1976

[54] ELECTROLYTIC APPARATUS

[75] Inventors: Hanns Fröhler, Munich; Erwin Rossberger, Hohenrain, both of Germany

[73] Assignee: Dipl.-Ing. Hanns Fröhler KG, Pullach near Munich, Germany

[22] Filed: Feb. 6, 1975

[21] Appl. No.: 547,732

[30] Foreign Application Priority Data

Feb. 15, 1974 Germany ..... 2407312

[52] U.S. Cl. ..... 204/269; 204/95; 204/147; 204/196; 204/279

[51] Int. Cl.[2] ..... C25B 1/26; C25B 1/34; C25B 9/00; C25B 9/04

[58] Field of Search ..... 204/269, 270, 196, 147, 204/149, 278, 95, 94

[56] References Cited

UNITED STATES PATENTS

| | | | |
|---|---|---|---|
| 892,983 | 7/1908 | Digby | 204/95 |
| 1,269,566 | 6/1918 | MacDougall et al. | 204/256 X |
| 3,102,086 | 8/1963 | Cotton et al. | 204/148 X |
| 3,412,000 | 11/1968 | Bedi | 204/147 |
| 3,766,044 | 10/1973 | Westerlund | 204/268 |

*Primary Examiner*—John H. Mack
*Assistant Examiner*—A. C. Prescott
*Attorney, Agent, or Firm*—Hans Berman; Kurt Kelman

[57] ABSTRACT

Sodium chloride in aqueous solution is converted to hypochlorite and chlorate by electrolysis in groups of cells whose electrodes are connected to a DC source in series circuit while the electrolyte is pumped through the cells in parallel flow between a distribution manifold and a collecting manifold connected to the cells by glass pipes. The manifold system consists of flangedly connected titanium pipes protected against electrolytic corrosion by electrical insulation between the sections and a small protective electrode having a platinum alloy surface and conductively connected to the anode pipe end adjacent the insulation.

7 Claims, 6 Drawing Figures

ELECTROLYTIC APPARATUS

This invention relates to electrolytic apparatus, and particularly to apparatus in which the electrodes of a plurality of electrolytic cells are connected in series circuit with the terminals of a DC source while electrolyte is supplied to the cells through manifolds for parallel flow of electrolyte through the several cells.

The invention will be described hereinbelow more specifically with reference to a plant for producing alkali metal chlorate, particularly sodium chlorate, by electrolysis of an alkali metal chloride solution. When sodium chloride is electrolyzed in apparatus having a plurality of cells electrically connected in series circuit, but arranged for parallel electrolyte flow through the cells, the electrolyte in the manifold system forms a shunt or secondary current path by-passing the primary current path through the electrodes in at least some of the cells.

The loss of current efficiency caused by the secondary current path can be held within tolerable limits by making the manifold system of non-conductive material. When the cells are equipped with graphite anodes, the temperature of the electrolyte cannot exceed 40°C to avoid excessive loss of material from the graphite electrodes, and polyvinyl chloride is a suitable material of construction for the manifold system.

More recently, graphite anodes have been replaced by titanium electrodes coated with platinum, usually in the form of a mechanically relatively strong platinum-iridium alloy. Such anodes readily resist attack by the concentrated solution of sodium chloride and of its products of electrolytic decomposition at temperatures of 60° to 80°C at which the hypochlorite initially formed is converted to chlorate much faster than at 40°C, thereby permitting a reduction in the size of the equipment for equal output of chlorate. Polyvinyl chloride, even when subjected to supplemental chlorination, does not withstand attack by the hot electrolyte, particularly in areas of high flow velocity.

Platinum-clad titanium pipes would satisfy the corrosion requirements, but are not economically practical. It has now been found that pipes of titanium or of titanium alloys mainly consisting of titanium and having essentially the same electrochemical properties can be employed if their anodic areas are provided with protective electrodes having surfaces of platinum or like material which does not form a passivating oxide film in the electrolyte so that current flow between the protective electrodes and the electrolyte is not opposed by the overvoltage caused by the normal oxide film on titanium. This film is readily destroyed when unprotected titanium pipes are employed in the manifold system of electrolysis apparatus with which this invention is concerned where the pipes are anodic relative to the electrolyte.

In order to avoid excessive current losses in the secondary path by flow of the current through the metallic walls of the manifold system, it is necessary that the system be subdivided into sections of which at least some consist of insulating material. Glass is a suitable material at least for the sections of the system immediately adjacent the cells, themselves made of ceramic or like material, so that the resistance of the electrolyte in the glass pipes limits current flow through the secondary path to not more than about 3% of the current flowing between the terminals of the associated DC source.

Because of the potential drop along the secondary current path, a continuous titanium manifold system connecting the glass pipes to the circulating pump and/or the processing tank which form a hydraulic circuit with the cells functions as a bi-polar electrode having a cathodic end and an anodic end. These ends differ in potential from the contacting electrolyte because the ohmic resistance of the metal is much lower than that of the electrolyte under all practical conditions.

As will presently be described in more detail, the protective electrodes of the invention are useful not only in the electrolysis of alkali metal chlorides to the corresponding chlorates. The invention thus resides in an improvement of electrolytic apparatus in which a plurality of electrolytic cells each enclose at least two electrodes which are conductively connected to the terminals of a source of direct current in series circuit for sequential flow of the current through the cells in a primary path. A manifold system connects the cells to a source of an electrolyte in parallel whereby the manifold system, when filled with electrolyte, constitutes a secondary path of current between the terminals of the DC source.

In this basically conventional arrangement, the invention provides the manifold system with pairs of conduits which communicate with each other for flow of electrolyte therethrough between its source and at least one of the cells. Electrical insulation prevents direct flow of current from one of the two conduits of each pair to the other conduit. The one conduit essentially consists of titanium, zirconium, tantalum, or an austenitic stainless steel. The metal of the conduit and the electrolyte are matched in such a manner that the electrolyte is incapable of significant chemical attack on the metal while causing electrolytic corrosion of the metal when current flows in its secondary path through the manifold system. A protective electrode is conductively connected to the one conduit and has a surface exposed to the electrolyte adjacent the insulation. The surface consists of a conductive material resistant both to electrolytic corrosion and chemical attack by the electrolyte.

Other features and many of the attendant advantages of this invention will be more fully appreciated as the same becomes better understood by reference to the following detailed description of preferred embodiments when considered in connection with the appended drawing in which.

Figure 1:
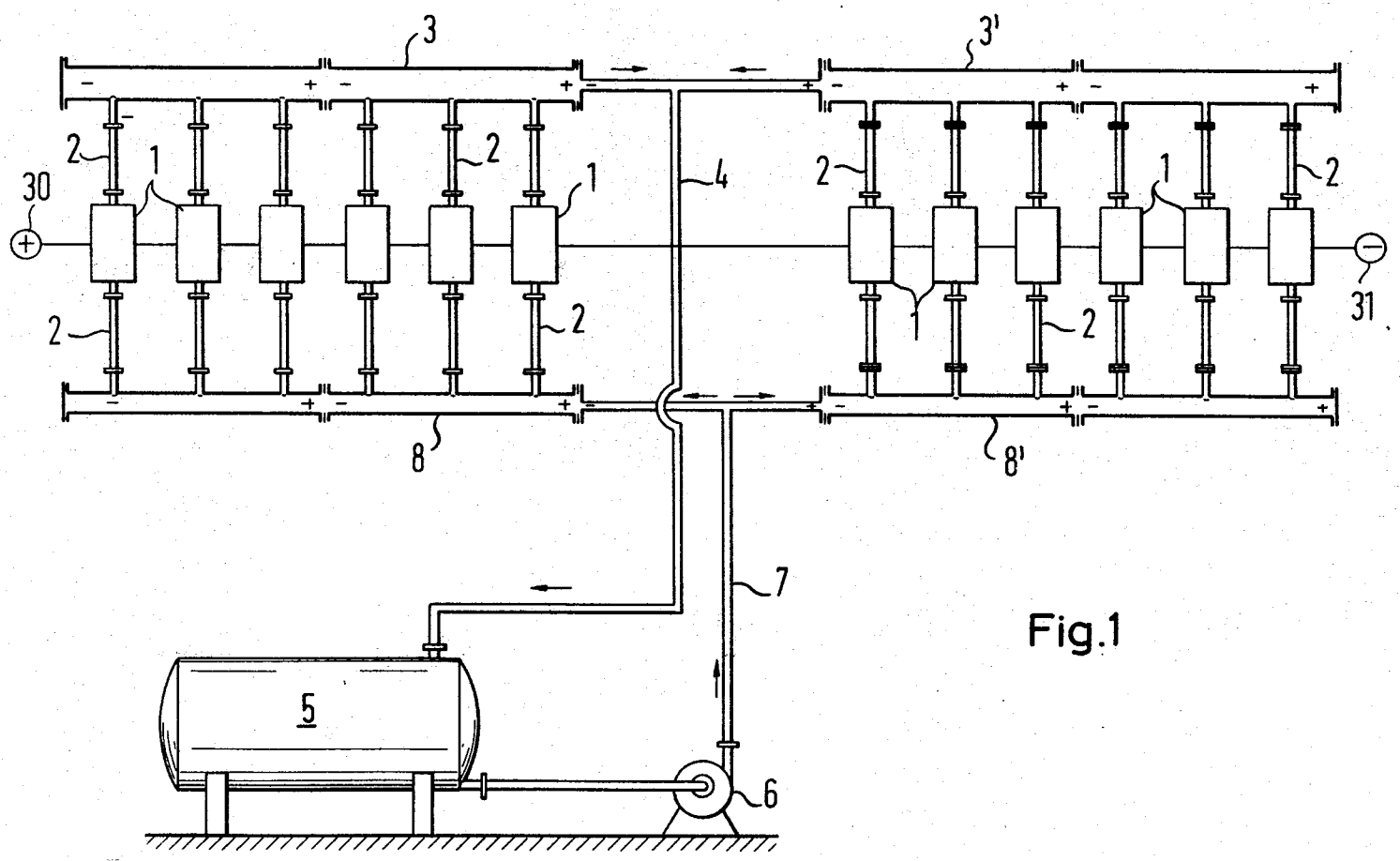
FIG. 1 shows electrolytic apparatus of the invention in an elevational view, elements of the apparatus being partly represented by conventional symbols.

Referring now to the drawing in detail, and initially to FIG. 1, there is shown as much of a plant for the electrolytic production of sodium chlorate as is needed for an understanding of this invention, the plant and its operation being conventional as far as not otherwise specifically described.

Twelve electrolytic cells 1 are connected in series between the terminals 30, 31 of a DC generator or rectifier as a DC source. Glass pipes 2 are flanged to the top and bottom walls of each cell. Groups of six cells 1 are each connected by pipes 2 to a common collector manifold 3, 3', and the two manifolds 3, 3' are drained by a forked return line 4 to a tank 5. The intake conduit of a centrifugal pump 6 is connected to the tank 5, and the pump discharge conduit 7 is forked and connected to two distributor manifolds 8, 8' respectively linked with the two groups of cells 1 by glass pipes 2. Each of the manifolds 3, 3', 8, 8' consists of two sections flanged to each other end to end.

As is not shown explicitly, but known in itself, the tank 5 is equipped with heat exchangers for maintaining a desired temperature in the electrolyte circulated by the pump 6, with a feeding arrangement for dissolving more sodium chloride in the partly exhausted electrolyte, and with means for discharging sodium chlorate which may crystallize from the electrolyte.

Figure 2:
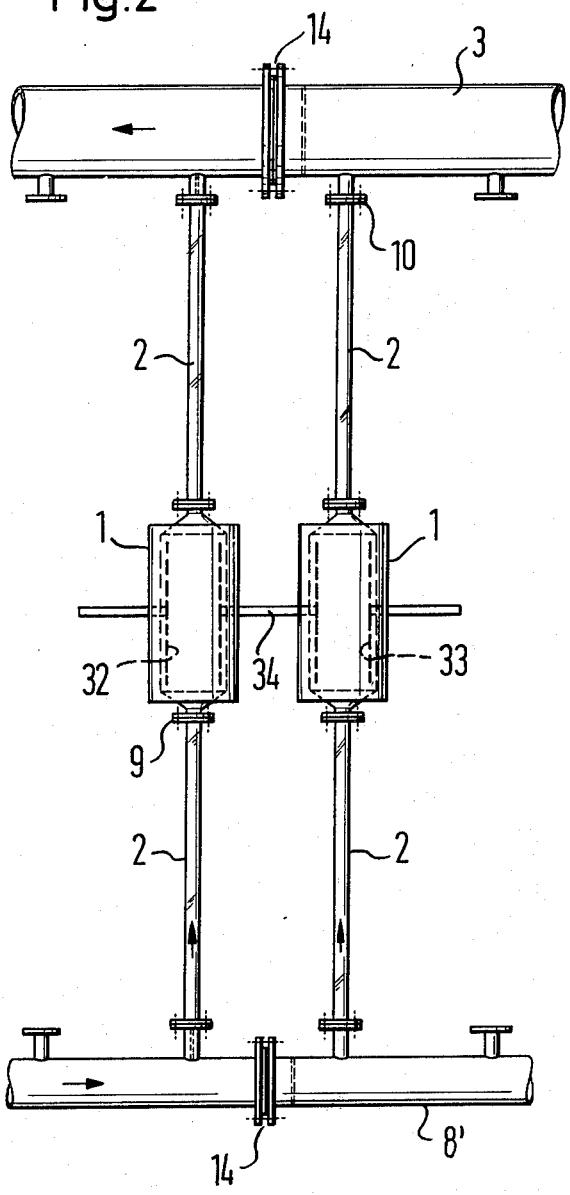
FIG. 2 illustrates a portion of the apparatus of FIG. 1 on a larger scale.

FIG. 2 shows the flanged connection of two sections of a collector manifold 3 and of a distributor manifold 8 as well as the two electrolytic cells 1 connected by glass pipes 2 to the sections adjacent their connection. Each cell contains an anode assembly 32 and a cathode assembly 33 indicated in FIG. 2 by conventional symbols. A bus bar 34 connects the anode assembly of one of the two cells to the cathode assembly of the other cells, and other bus bars connect the two cells shown in FIG. 2 to the other cells of the plant and ultimately to the DC source in the manner evident from FIG. 1 and conventional in itself.

Figure 3:
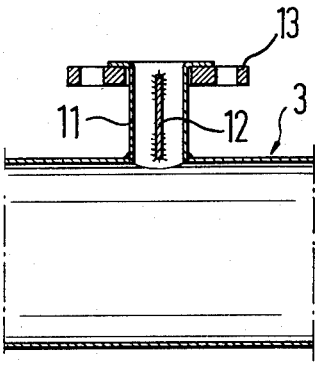
FIG. 3 shows a detail of the device of FIG. 2 in elevational section.

The flanges 9 which connect each glass pipe 2 to a cell 1 are conventional. A connection 10 between a glass pipe 2 and the manifold 3 is shown in more detail in FIG. 3. The bore of a short branch 11 of the manifold 3 is bi-sected by a rectangular plate 12 elongated in the direction of liquid flow through the branch. The two longitudinal edges of the plate 12 are welded to the inner wall of the branch 11 which is connected to the associated glass pipe 2 by loose flanges 13 and non-illustrated fasteners. The manifolds 3, 3', 8, 8' and the forked conduits 4, 7 consist of titanium or titanium alloy, 2 mm thick, and the plate 12 consists of titanium carrying a surface coating of platinum alloy (70% Pt, 30% Ir), 1 micron thick. All branches of the manifolds 3, 3', 8, 8' are connected to the associated glass pipes 2 in the same manner.

Figure 4:
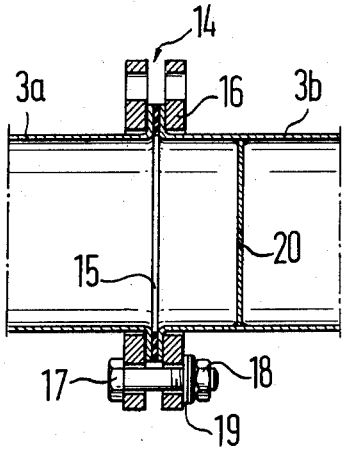
FIG. 4 shows another detail of the device of FIG. 2 in elevational section.

One of the flanged connections 14 between the two sections **3*a*, 3*b* of the manifolds 3 is shown on a larger scale in FIG. 4. The two flanged ends of the sections 3*a*, 3*b* are separated by a ring 15 of electrically insulating silicone rubber and secured to each other by two loose metal flanges 16, bolts 17 and nuts 18, only one bolt and nut being shown in the drawing. The bolt 17 is electrically insulated from the section 3*b* by a plastic washer 19 carrying a plastic sleeve. Closely adjacent the ring 15, the two ends of a narrow bar 20 of titanium clad with platinum-iridium alloy are welded to diametrically opposite inner wall portions of the manifold section 3*b*. Another, identical bar is welded to the manifold wall at right angles to the bar 20 but is obscured by the bar 20 in the view of FIG. 4.**

Figure 5:
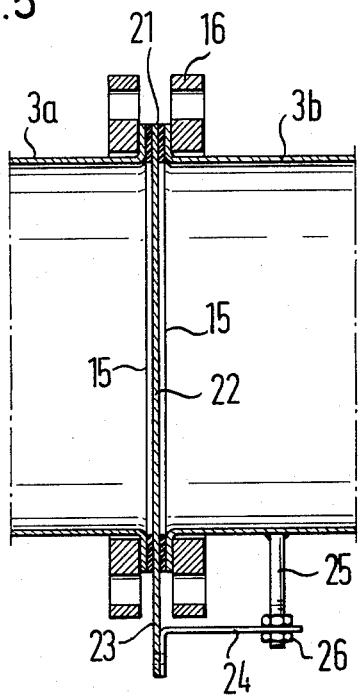
FIGS. 5 and 6 illustrate modifications of the device of FIG. 4 in analogous views.

A modified connection between two manifold sections is shown in FIG. 5. The flanged ends of the sections **3*a*, 3*b* are separated by a sandwich consisting of two asbestos plastics rings 15 and a ring 21 of platinum-clad titanium integral with a bar 22 of the same material extending along a diameter of the manifold. An integral lug 23 of the ring 21 projects radially outward beyond the flanges 16 and is conductively connected to the manifold section 3*b* by a flat bar 24 and a pin 25 which is welded to the outer face of the section 3*b* and attached to the bar 24 by nuts 26.**

Figure 6:
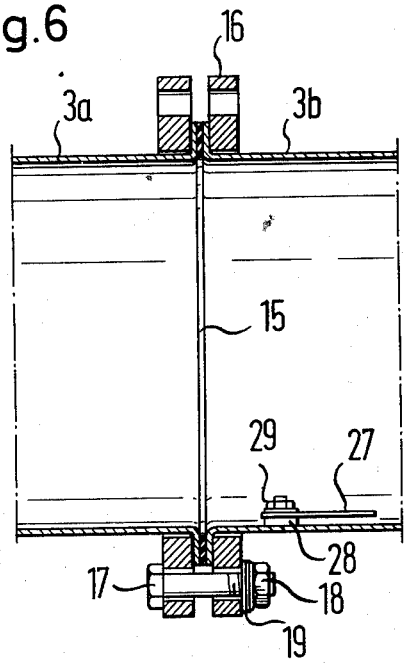

Yet another modified connection between two manifold sections is shown in FIG. 6. It is largely identical with the device described above with reference to FIG. 4, but the cross of bars 20 is replaced by a plate 27 of titanium clad with platinum alloy which is elongated in the direction of the manifold axis and conductively attached to the inner wall of the section **3*b* by a partly threaded boss 28 passing through an opening in the plate 27 and a nut 29.**

It will be appreciated that the several devices shown in FIGS. 3 to 6 may be used interchangeably in the apparatus of FIG. 1 wherever a conductive conduit communicates with another conductive conduit from which it is electrically insulated. As is not explicitly shown, the junctions between the forked return line 4 and the manifold 3 and those between the manifold 8 and the pump discharge conduit 7 are similarly equipped with electrodes more resistant to electrolytic corrosion than the titanium metal or alloy from which the metallic pipes and conduits are constructed. Where only one of two connected titanium pipes is provided with a protective platinum electrode, the protective electrode is attached to the titanium conduit which will become anodic during normal plant operation. For best protection, however, both pipe ends may be protected, not specifically illustrated, in a manner obvious from FIGS. 3, 4, and 6. Current flows between a protected pipe and the electrolyte confined therein almost entirely through the platinum surface of the protective electrode which is not affected thereby, and no electrolytic corrosion occurs at the titanium surface.

Unprotected titanium forms a superficial hydride layer when made the cathode in contact with any electrolyte at a potential difference sufficient to generate hydrogen. The hydride formation leads to a distortion of the crystal lattice in the metal and to measurable surface roughness which in turn causes concentration of mechanical, thermal, and chemical stresses. A protective electrode attached to a cathodic area of a titanium pipe prevents formation of the hydride layer and of its consequences.

In FIG. 1, plus and minus signs indicate the polarities assumed by pipe ends during operation of the plant. All branches of the manifolds 3', 8' joined to glass pipes 2 are anodic and thus need protection by platinum-clad electrodes, whereas the corresponding branches of the manifolds 3, 8 may be left unprotected against the current flowing between the terminals of the associated generator or rectifier and by-passing some of the cells 1 through the manifolds 3, 3', 8, 8' and the forks of the conduits 4, 7 in a secondary path.

The potential difference between the electrolyte and the anodic and cathodic areas of a titanium pipe in the manifold system is a direct function of the spacing of the two areas under otherwise comparable conditions. At least some of the advantages of this invention could be achieved by providing only one or very few protective electrodes with associated insulation in the apparatus illustrated in FIG. 1. However, it is necessary to subdivide conduits in the secondary current flow path, such as the manifolds 3, 3', 8, 8', to achieve full protection of the manifold walls against electrolytic corrosion. Each manifold has been shown to consist of two sections electrically insulated from each other. More sections may be resorted to if so desired.

The apparatus shown in FIG. 1 has been operated successfully for 6 months at a current flow of 6000 amps. for electrolyzing concentrated sodium chloride solution at 60° to 80°C without showing any evidence of corrosion. When an earlier attempt was made to operate it without the protective electrodes of this invention and the insulating rings electrically separating the several conduits of titanium alloy, perforations having a diameter of 4 – 6 mm formed in the titanium walls within eight hours.

When equipped with protective electrodes, the apparatus showed improved current efficiency, that is, a higher yield of sodium chlorate per unit of consumed current. It is believed that the protective electrodes function as anodes for the oxidation of chloride ions to hypochlorite ions and thereby contribute not only to the useful life of the apparatus, but also to its operation.

The titanium clad with platinum-iridium alloy was chosen for the protective electrodes in the illustrated apparatus because the same material was employed for the electrodes in the cells 1, however, magnetite or carbon in the form of conductive graphite may be substituted if so desired. The exposed surface of the protective electrode need be no greater than a minute fraction, typically 0.001% to 1% of the surface area of the titanium conduit protected by the electrode. The location of the protective electrode should be closely adjacent the insulating material which prevents direct current flow between the protected titanium wall and a consecutive conduit in the path of electrolyte flow, whether the other conduit consists of titanium or of glass, the maximum permissible distance being determined by the potential drop in the electrolyte between the protective electrode and the end of the titanium conduit, and by the potential difference between the titanium wall and the electrolyte at which significant electrolytic corrosion of the titanium wall begins, normally about 8 – 10 volts.

Zirconium and tantalum pipes are not economical substitutes at this time for titanium and alloys essentially consisting of titanium. However, these more expensive metals react to an electrolyte containing alkali metal chloride and its products of electrolysis in approximately the same manner as titanium and are equally protected by the auxiliary or protective electrodes of this invention. Such electrodes also are used to advantage in similar electrolytic apparatus employed for the production of alkali metal persulfates or the decomposition of water to hydrogen and oxygen. Stainless steel containing up to 12% nickel, 20% chromium and a few percent molybdenum or titanium, such as the austenitic steels of Type 316, may be employed in the production of persulfate.

It is a common feature of the metals employed in manifold systems according to this invention that they are protected against chemical attack by the electrolyte by an oxide layer which cannot prevent electrolytic corrosion when the metal becomes anodic relative to the electrolyte beyond a critical potential value. This overvoltage which opposes current flow between the metal and the electrolyte determines the choice of the surface material for the protective electrode whose overvoltage must be smaller.

It should be understood, of course, that the foregoing disclosure relates only to preferred embodiments, and that it is intended to cover all changes and modifications of the examples of the invention herein chosen for the purpose of the disclosure which do not constitute departures from the spirit and scope of the invention set forth in the appended claims.

What is claimed is:

1. Electrolytic apparatus comprising:

a. a plurality of electrolytic cells;

b. a plurality of electrodes in each cell;

c. conductive means for connecting said electrodes to the terminals of a source of direct current in series circuit for sequential flow of said current through said cells in a primary path;

d. a source of an aqueous electrolyte; and e. a manifold system connecting said cells to said source of an electrolyte in parallel, whereby said system when filled with said electrolyte constitutes a secondary path of current between said terminals, said system including 1. two conduits communicating with each other for flow of said electrolyte therethrough between said source thereof and one of said cells, 2. electrical insulating means preventing direct flow of current from one of said two conduits to the other conduit, said one conduit essentially consisting of a metal selected from the group consisting of titanium, zirconium, tantalum, and austenitic stainless steel, said electrolyte being incapable of significant chemical attack on said metal while causing electrolytic corrosion of said metal when current flows in said secondary path, and 3. a protective electrode conductively connected to said one conduit and having a surface exposed to said electrolyte adjacent said insulating means, said surface consisting of a conductive material resistant to said electrolytic corrosion and said chemical attack.

2. Apparatus as set forth in claim 1, wherein said surface essentially consists of platinum, magnetitite, or carbon.

3. Apparatus as set forth in claim 2, wherein said metal is titanium, and said electrolyte is an aqueous solution of alkali metal chloride and of the products of electrolysis of said alkali metal chloride.

4. Apparatus as set forth in claim 3, wherein the area of said surface is a small fraction of the surface area of said one conduit exposed to said electrolyte.

5. Apparatus as set forth in claim 4, wherein said small fraction is between 0.001% and 1%.

6. Apparatus as set forth in claim 1, wherein the overvoltage opposing hydrogen deposition on said metal from said electrolyte is greater than the overvoltage opposing hydrogen decomposition on said surface from said electrolyte.

7. Apparatus as set forth in claim 1, further comprising a pump interposed between said source and said manifold system for feeding said electrolyte to said cells, and means for continuously withdrawing electrolyte from said cells.

* * * * *